US006595304B2

(12) United States Patent
Chen

(10) Patent No.: US 6,595,304 B2
(45) Date of Patent: Jul. 22, 2003

(54) ROLLER BIT PARALLEL INLAYED COMPACTS

(75) Inventor: Zhihua Chen, Qianjiang (CN)

(73) Assignee: Kingdream Public Limited Company, Hubei (CH)

( * ) Notice: Subject to any disclaimer, the term of this patent is extended or adjusted under 35 U.S.C. 154(b) by 0 days.

(21) Appl. No.: 09/824,133

(22) Filed: Apr. 3, 2001

(65) Prior Publication Data

US 2002/0000335 A1 Jan. 3, 2002

(30) Foreign Application Priority Data

Jun. 29, 2000 (CN) ..... 00114661 A

(51) Int. Cl.[7] ..... E21B 10/08; E21B 10/16
(52) U.S. Cl. ..... 175/378; 175/377; 175/428
(58) Field of Search ..... 175/327, 331, 175/377, 378, 429, 428, 431

(56) References Cited

U.S. PATENT DOCUMENTS 233,746 A * 10/1880 Scott et al. ..... 246/51
1,847,824 A * 3/1932 Failing ..... 175/376
1,871,736 A * 8/1932 Reed ..... 175/340
1,885,085 A * 10/1932 Dalzen ..... 175/374
1,896,251 A * 2/1933 Scott ..... 175/378
2,927,778 A * 3/1960 Coulter, Jr. ..... 175/341
3,003,370 A * 10/1961 Coulter, Jr. ..... 148/211
3,098,535 A * 7/1963 Rason ..... 175/374
3,104,726 A * 9/1963 Davis ..... 175/331
3,442,342 A * 5/1969 McElya et al. ..... 175/374
4,058,177 A * 11/1977 Langford, Jr. et al. ..... 175/374
4,086,973 A * 5/1978 Keller et al. ..... 175/374
4,108,260 A * 8/1978 Bozarth ..... 175/374
4,262,761 A * 4/1981 Crow ..... 175/374
4,453,836 A * 6/1984 Klima ..... 175/371
4,716,977 A * 1/1988 Huffstutler ..... 175/426
5,131,480 A * 7/1992 Lockstedt et al. ..... 175/374
5,201,376 A * 4/1993 Williams ..... 175/374
5,421,423 A 6/1995 Huffstutler
5,531,281 A * 7/1996 Murdock ..... 175/431
5,676,214 A * 10/1997 Pearce et al. ..... 175/340
5,967,245 A * 10/1999 Garcia et al. ..... 175/374
5,979,575 A * 11/1999 Overstreet et al. ..... 175/341
6,059,054 A * 5/2000 Portwood et al. ..... 175/430
6,161,634 A * 12/2000 Minikus et al. ..... 175/331
6,176,329 B1 * 1/2001 Portwood et al. ..... 175/341
6,209,668 B1 * 4/2001 Pessier et al. ..... 175/371
6,241,034 B1 * 6/2001 Steinke et al. ..... 175/331
6,347,676 B1 * 2/2002 Vuyk, Jr. ..... 175/331
6,367,568 B2 * 4/2002 Steinke et al. ..... 175/331
6,394,199 B1 * 5/2002 Skyles et al. ..... 175/336
6,422,327 B1 * 7/2002 Portwood et al. ..... 175/341
2001/0027881 A1 * 10/2001 Steinke et al. ..... 175/374
2002/0092684 A1 * 7/2002 Singh et al. ..... 175/339

* cited by examiner

*Primary Examiner*—David Bagnell
*Assistant Examiner*—Jennifer H Gay
(74) *Attorney, Agent, or Firm*—Browdy and Neimark, P.L.L.C.

(57) ABSTRACT

This invention relates to a roller bit applying for the oil, natural gas, mine and geological drilling, and more particularly relates to a kind of roller bit with the parallel inlayed compacts, it includes head and cone, the compact land and the teeth-groove are arranged on the cone, the difference is that there are 2 to 3 compacts having the cylindrical body being arranged on the top of the base teeth along the teeth direction.The cutting performance of the present invention is similar to that of the oblate compacts, and, by utilizing the conventional cylindrical compacts, it is not only easy to process and with low manufacturing cost, but the bit can effectively drill through the stringered earth formation with both hard and soft formation and thus better economic benefit from drilling the stringered formation can be obtained.

10 Claims, 3 Drawing Sheets

ROLLER BIT PARALLEL INLAYED COMPACTS

BACKGROUND OF THE INVENTION

1. Technical Field of the Invention

This invention relates to a roller bit for use in drilling for the oil, natural gas, mine and geological drilling, and more particularly relates to a roller bit with the parallel inlayed compacts.

2. Prior Art

Roller bits have been widely used as a tool for earth boring. A roller bit usually consists of the cone and the head. The cone may be one or more, and the head is moveably attached an inner hole of the cone by a suspending-arm shaft at the lower part of the head, so that the cone can rotate around the shaft. The cutting structure of the outer surface of the cone crushes the rock formation under the action of the impact and the slide shearing generated by the combined movement of the cutting structure with revolution, self-rotation and the axial advancement of the cone.

The prior art roller bits are divided into two sorts which are a steel-tooth bit and a compact bit. The teeth and the cone of the steel-teeth bit are integrally formed, with a broad tooth cutting edge which can effectively scrape and chisel the soft earth formation, but when a hard formation is reached, the steel-teeth are easily worn with the result of losing their cutting function. Even when coated with an abrasion-resistant material, the steel-teeth still crack or break when they encounter hard formations. In a geological formation with stringers, where a steel-tooth bit cannot effectively drill through the hard formation, a compact roller bit must be used. The compacts of this kind of bit are usually made from carbide, with higher hardness which are more wear-resistant, but the cutting edge of the compact not as broad as in the steel tooth bit and cannot effectively drill into a soft formation.

From this we can see that the prior art steel teeth bit and compact bit both cannot be effectively applied for use on a formation with stringers. In order to overcome the above problems, U.S. Pat. No. 5,421,423 discloses a kind of roller cone bit having the oblate compact with a longer crest. Although it can be effectively applied to an earth formation with stringers, it has an interference fit between an oblate compact and oblate holes on the cone which require that the compact as well as the holes be machined with very high precision. The manufacture of such a roller bit and oblate compact is difficult, inefficient and not cost effective.

OBJECT AND SUMMARY OF THE INVENTION

The object of this invention is to overcome the above problems and to provide a roller bit with parallel compacts which are easy to machine, but also low cost, and can drill through earth formation with stringers effectively.

The object of this invention can be realized by the following aspects: the roller bit according to present invention is constructed of head and cone. The cone has compacts for breaking the rock, and the head supports the cone. The lower part of the head has a cantilevered head shaft. The cone is mounted on the head shaft by means of a locking mechanism and a bearing couple which is between the cone inner hole and the head shaft permitting the cone to rotate around the shaft. Several compact lands and grooves are arranged on the cone. The compact lands are machined into several base teeth by milling, and two to three small cylindrical holes are parallelly machined at the top of the base teeth along the longitudinal direction of the teeth. The cylindrical compacts are inlayed into corresponding cylindrical holes, thus forming a roller-bit with a parallel inlayed compacts cutting structure.

According to the above aspects, a gap between the parallel inlayed compact may be 2 to 5 mm. The base of the compact is cylindrical in shape, which is interference fitted in the circular holes on the cone. The crest of the compact is wedge shaped, and has an elongated cutting edge. The teeth carrying the compact land can be the shape of a straight taper and straight teeth, or can be the shape of a spiral taper and spiral straight teeth. The spiral angle $\alpha$ is between 5 to 15 degrees to the generatrix of the cone.

The invention has the following advantages: 1. By employing parallel compacts, the cutting performance is similar to that of oblate compacts which have longer cutting edges. The noncontinuous long crest of compacts according to the invention are constructed so that it is easy to engage an earth formation and is thus helpful in improving rock breaking efficiency and the life of the bit. In addition, the teeth-groove and the annular separating groove create an advantage for chip removing, improvement of the cutting condition, and preventing bit balling; 2. By adopting a cylindrical body, it is not only easier to machine, but also creates high fitting precision, so that product quality can be guaranteed with low manufacture costs and good economy; 3. The roller bit according to the invention can drill through hard earth formations, and also break the hard earth formation with a scraping action, so it is effectively applied to earth formations with stringers, therefore increasing drilling efficiency.

DETAILED DESCRIPTION OF THE PREFERRED EMBODIMENT(S) OF THE INVENTION

Figure 1:
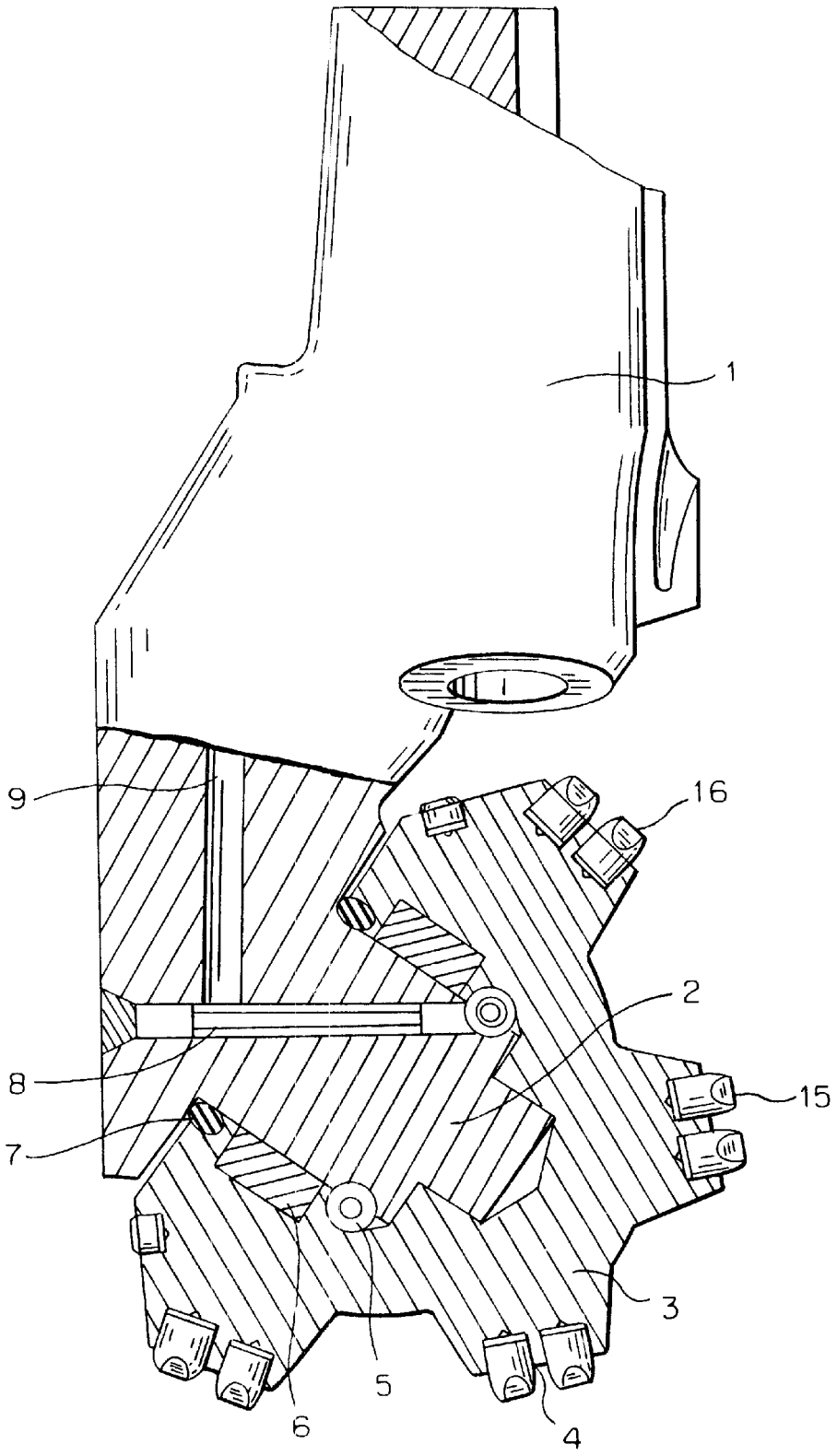
FIG. 1 is a partially cross-section view of the roller bit being taken partially according to one embodiment of this invention.

Now the detailed description will be given referring to the drawings. FIG. 1 is a partially cross-section view of the roller bit being taken partially according to one embodiment of this invention. The roller bit according to the invention includes a head 1 and a cone 3. The head 1 is coupled with the cone 3 through a suspending-arm shaft at the lower part thereof. A bearing couple is formed by a bearing pin 2 and the inner hole 13 of the cone 3. A steel locking ball 5 rotatably engages the cone 3 with the bearing pin 2 of the head. A rolling member 6 and a sealing ring 7 are arranged between the cone inner hole and the bearing pin. The sealing ring 7 prevents lubrication grease inside the bearing from leaking outside as well as preventing outside drilling liquid from entering into the bearing. A ball plug 8 on the head locks the steel ball 5 in position. A lube hole 9 provides a passage for supplying the lubricating grease to the bearing.

Figure 2:
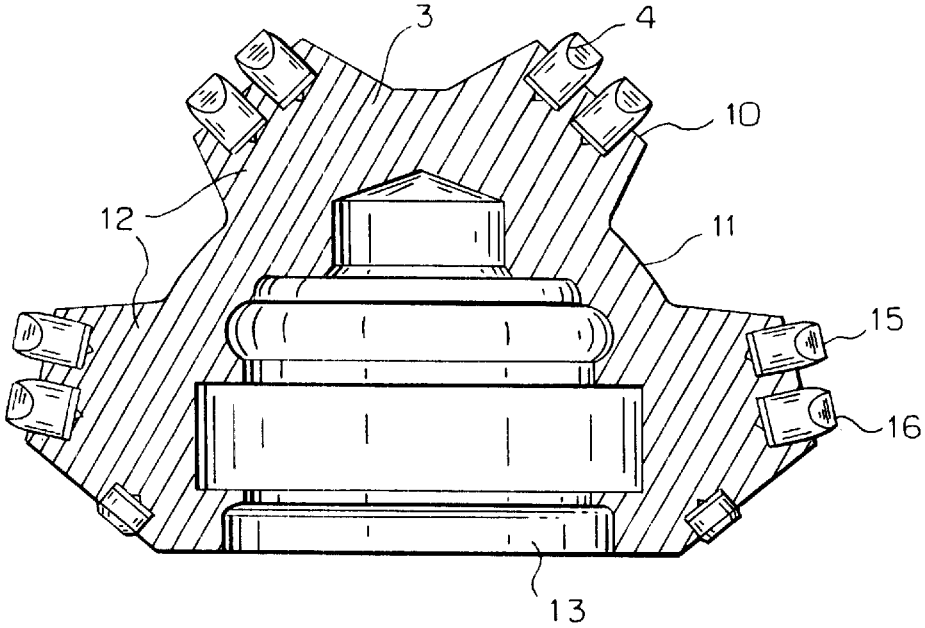
FIG. 2 is the front cross-section view of a cone according to one embodiment of this invention.
Figure 3:
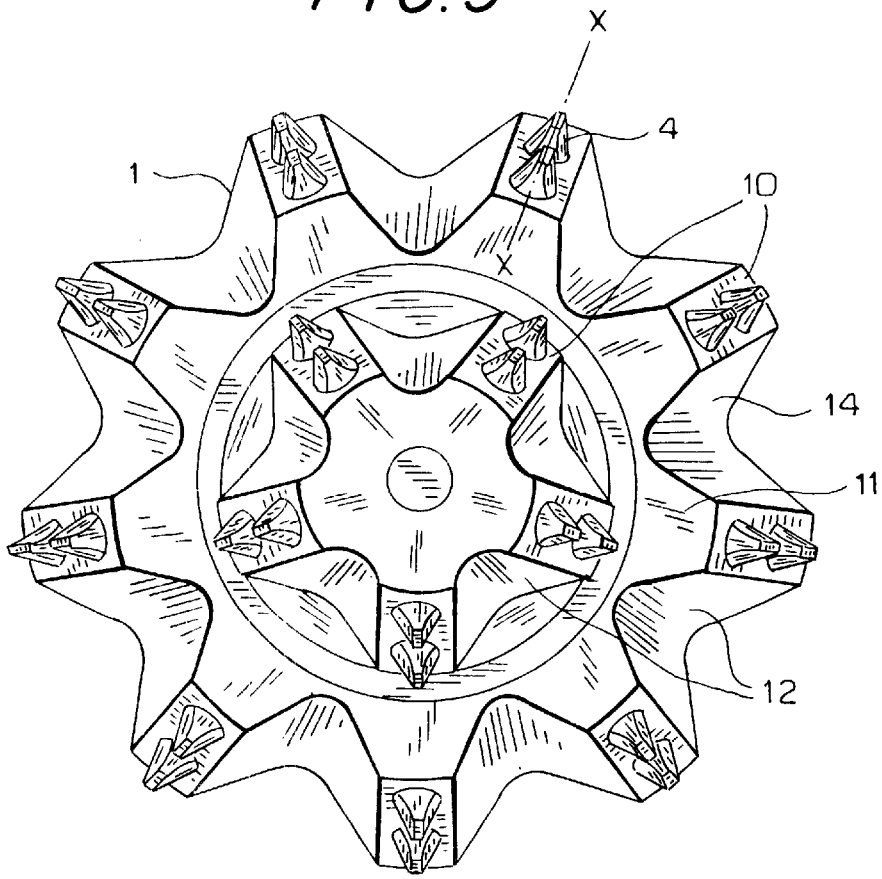
FIG. 3 is the top view of the cone according to one embodiment of this invention.

The structure of the cone is shown in FIG. 2 and FIG. 3 to have a connecting hole 13 in the cone which forms a bearing couple together with bearing pin 2 of the head. The cone shown in FIG. 2 and 3 has the shape of a straight taper having two sets of compact lands 10, one upper set and one lower set. Four layers of compact lands can be formed in this embodiment if desired. An annular separating groove 11 is arranged between the compact lands, and teeth-grooves 12 are made between each of the compact lands, from which base teeth 14 are formed. The base teeth 14 have a straight taper so that the direction of the teeth 14 is the same as that of the generatrix of the cone body. Two compacts 4 are parallelly arranged on the top of each of base teeth 14. The compact is made of carbide and with a normal shape, but it can also be made from other hard materials. The compact body is in the shape of cylinder which is firmly inlayed into a circular hole on the cone by interference fit. The crest of the compact is in the shape of wedge 15 forming a cutting edge 16 which is aligned with the cutting edge 16 of each compact on a specific land 10 and in a direction parallel to the longitudinal direction x-x of the tooth land. The gap between the two compacts ranges between 2 to 5 mm but is preferably 3 mm.

Figure 4:
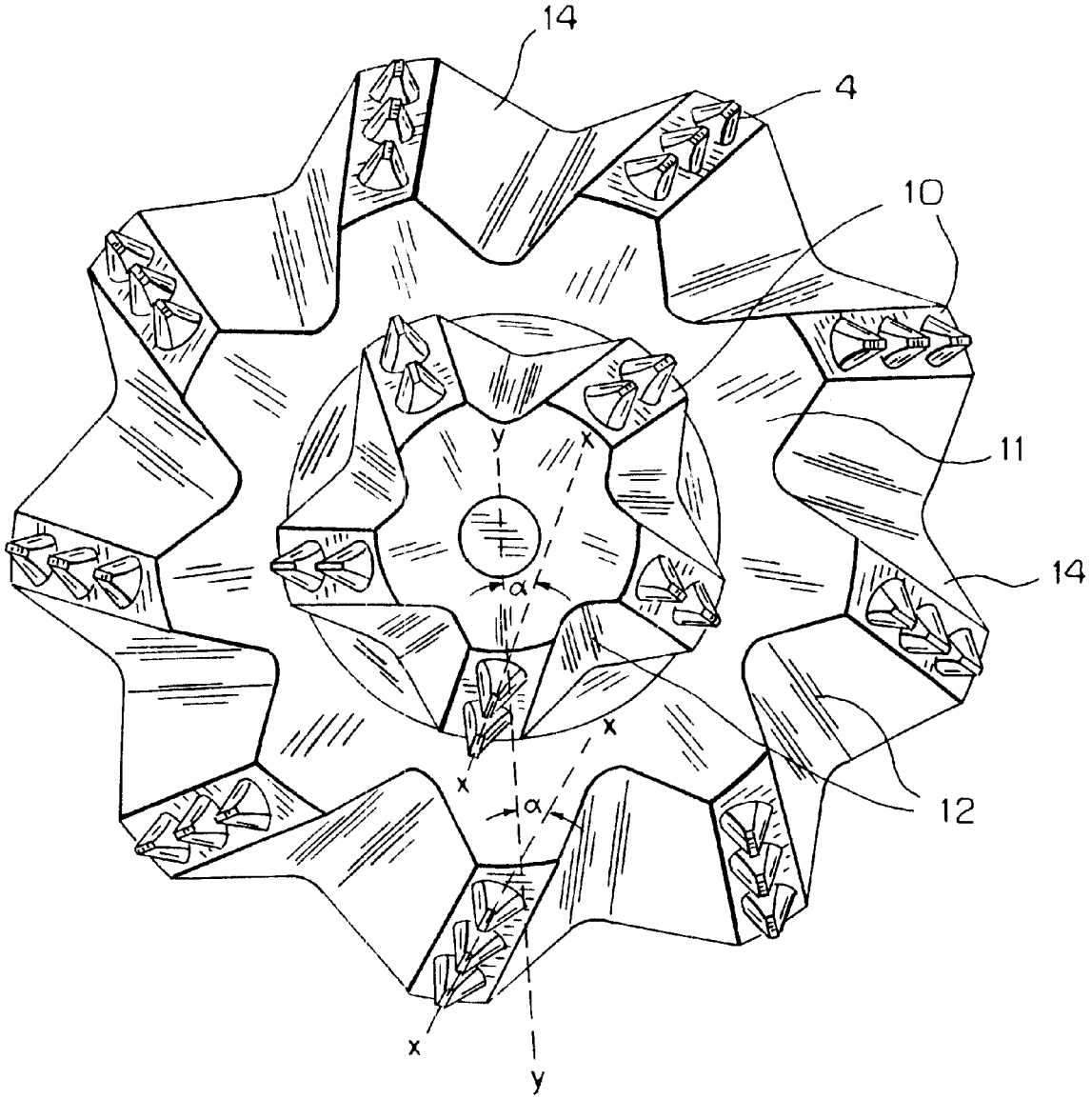
FIG. 4 is the top view of a cone according to another embodiment of this invention.

The second embodiment of this invention is shown in FIG. 4. The main difference from the embodiment of FIGS. 2 and 3 is that the longitudinal direction of the base teeth 14 biases at an angle relative to the generatrix y-y of the cone body so that the base teeth 14 have a spiral taper having a spiral angle $\alpha$ of between 5–15 degrees between the generatrix of the cone. There are two layers or sets of compact lands 10 arranged on the cone 3 as in the embodiment FIGS. 2 and 3, and four compact land layers or sets can be formed if desired. Two compacts 4 are parallelly arranged at the top of the base teeth 14 in the upper compact land along the longitudinal direction of the land, and three compacts are parallelly arranged at the top of the base teeth 14 in the lower compact land along the longitudinal direction of the land. The annular separating grooves 11 are arranged between the compact lands, and the teeth-grooves 12 are made on each of the compact land.

What is claimed is:

1. A rotary drill bit comprising:

a head (1); and at least one cone (3) rotatably engaged on the head (1), a plurality of base teeth (14) integrally formed on the cone (3) separated from each ocher by tooth grooves (12);

each of the base teeth (14) having a flat tooth and a top thereof;

a plurality of carbide compacts (4) separately engaged on each tooth land;

wherein each of the compacts have a cylindrical base which is interference fit in a hole in a corresponding tooth land and has an upper wedge shape forming an elongated cutting edge (16); and wherein an area of a cross-section through the cylindrical base of each of the compacts is smaller than an area of the corresponding land;

wherein a length of each of said elongated cutting edge (16) of the plurality of compacts (4) engaged on a tooth land of said tooth lands are aligned in a direction parallel to a longitudinal direction (x) of the corresponding tooth land.

2. The rotary drill bit according to claim 1, wherein a gap between the plurality of compacts engaged on the tooth land is between 2 to 5 mm.

3. The rotary drill bit according to claim 2, wherein the gap is 3 mm.

4. The rotary drill bit according to claim 1 wherein the base teeth respectively carrying the compact lands (3) each have a straight taper relative to a generatrix of the cone.

5. The rotary drill bit according to claim 1, wherein the base teeth respectively carrying the compact lands (3) each have a spiral taper relative to a generatrix of the cone.

6. The rotary drill bit according to claim 5, wherein the spiral taper forms a spiral angle $\alpha$ between the longitudinal direction of the tooth land and the generatrix of the cone.

7. The rotary drill bit according to claim 6, wherein the spiral angle a is between 5 and 15 degrees.

8. The rotary drill bit according to claim 5, wherein there is an upper and a lower set of tooth lands arranged on the cone, two compacts (4) being engaged on each of the tooth lands of the upper set of tooth lands and three compacts (4) being engaged on each of the lower set of tooth lands;

wherein an annular separating groove (16) is machined between the upper and lower set of tooth lands and the teeth grooves (12) are made on the upper and lower set of tooth lands between the tooth lands of each set of tooth lands.

9. The rotary drill bit according to claim 1, wherein 2 to 4 sets of tooth lands are arranged on the cone (3), annular separating grooves (11) are machined between each of the sets of tooth lands and the teeth grooves (12) are made on each of the sets of tooth lands between the tooth lands of each of the sets of tooth lands.

10. The rotary drill bit according to claim 1, wherein there are two compacts on each of the tooth lands.

* * * * *